US006606827B1

(12) United States Patent
Hoffmann

(10) Patent No.: US 6,606,827 B1
(45) Date of Patent: Aug. 19, 2003

(54) LIT-UP MARKING DEVICE FOR STEPS AND GRANDSTANDS

(76) Inventor: Friedemann Hoffmann, C/Alicante, 16-Polg. Ind. Fonollar, 08830 Sant Boi de Llobregat, Barcelona (ES)

( * ) Notice: Subject to any disclaimer, the term of this patent is extended or adjusted under 35 U.S.C. 154(b) by 33 days.

(21) Appl. No.: 10/031,846

(22) PCT Filed: Aug. 1, 2000

(86) PCT No.: PCT/ES00/00300

§ 371 (c)(1),
(2), (4) Date: Jan. 23, 2002

(87) PCT Pub. No.: WO01/09458

PCT Pub. Date: Feb. 8, 2001

(30) Foreign Application Priority Data

Aug. 2, 1999 (ES) ..... 9901757

(51) Int. Cl.[7] ..... E04F 11/16

(52) U.S. Cl. ..... 52/28; 52/179; 52/184; 362/146

(58) Field of Search ..... 52/179, 176, 28, 52/182, 184; 362/145, 146, 153

(56) References Cited

U.S. PATENT DOCUMENTS 4,625,266 A * 11/1986 Winter ..... 362/146
4,888,669 A * 12/1989 Hanson ..... 362/145
5,430,627 A * 7/1995 Nagano ..... 362/146
6,047,506 A * 4/2000 Kemper ..... 52/179
6,412,538 B1 * 7/2002 Welfonder ..... 160/271
6,416,200 B1 * 7/2002 George ..... 362/146

FOREIGN PATENT DOCUMENTS

GB 2115451 A * 12/1982 ..... E04F/11/16

* cited by examiner

*Primary Examiner*—Carl D. Friedman
*Assistant Examiner*—Basil Katcheves
(74) *Attorney, Agent, or Firm*—Notaro & Michalos P.C.

(57) ABSTRACT

This device has a principal section (1) and an auxiliary section (6) with means of attachment and detachment under pressure. The auxiliary section (6) has guides (61) for fitting an advertising support (7). The section (1) defines two wings (11 and 12), a recess (13) for the lighting means (2) and a seat (14) for a non-slip strip (4) and a row-numberer (5). The wing (12) has a longitudinal channel (17) for fitting lighting means (8) and a transparent protector, forming a hollow portion (9) for running cables (81) through it. The seat (14) has two interior mortised portions (14*a* and 14*b*), one of which forms a duct for the power-supply cables (51) of lighting means (52) housed in the orifice (53) of the numberer (5).

11 Claims, 7 Drawing Sheets

LIT-UP MARKING DEVICE FOR STEPS AND GRANDSTANDS

OBJECT OF THE INVENTION

This invention relates to a lit-up marking device of the type which has an angular section, used for positioning on the front vertex of the step, which defines two substantially perpendicular branches and a longitudinal ducting for fitting means of lighting and a translucent or transparent protector.

BACKGROUND OF THE INVENTION

As background of the invention, Utility Models 293.909, 9802069 and 9803048, held by the applicant for this invention, may be mentioned.

Utility Model 293.909 relates to a protector for the front edge of the steps which is made up of an angular section whose front, upper zone has a continuous chamber for the fitting of a string of incandescent lights and a transparent or translucent plate which acts as protector for the lights which form the step-marking means.

Utility Model 9802069 describes a marking device for floors which, having an arrangement similar to that of the Model described above, has the particular feature that the ends of the wings of the section are slightly raised to form carpet retainers. The upper wing of the section also presents a longitudinal seat for fitting a strip of anti-slip material, thereby preventing users slipping when they walk on the metal section. Said Model further includes some wedge-shaped sections which act as a trim for the lit-up marking section where no carpet has been laid on either of the sides of same.

Utility Model 9803048 relates to improvements in lit-up marking device for grandstands, steps and the like; in accordance with said improvements, the section for fitting onto the front side of the step, grandstands and the like has a generally L-shaped layout whose front wing is formed by a vertical prolongation which runs from the longitudinal channel in which the lighting means are housed.

This wing has an end portion with which it makes contact with the front of the step, so that its middle zone is separated from the latter to form a cable ducting. The aforesaid front wing has on its front surface longitudinal guides for fitting an advertising plate or support. This advertising plate or support is lit from the back zone, for which purpose some orifices have previously to be made in the section for fitting of the corresponding lighting means in a position facing them.

This Model also makes provision for fitting a row-numbering plate on one of the side ends of the upper seat, by using the remaining length of the upper portion of the seat for fitting the anti-slip strip of material mentioned above.

The row-numbering plates are lit up from the lower zone, for which purpose some holes have to be made previously in the upper wing of the section for fitting of the corresponding lighting means in a position facing them.

Said improvements, by providing novel characteristics, such as the possibility of including row-numbering plates or an advertising support, involve some problems for the manufacturer and the fitter, such as the need to keep a larger stock since, depending on the end customer, a section must be fitted which permits the attachment of advertising or no attachment thereof, or the need to drill in the section some holes for fitting the means of lighting of the row-numbering plate and the advertising support.

Patent GB 2 115 451 describes: "a unit for illuminating a step comprising a combination of a stair tread moulding and a second moulding, the second moulding being formed with a recess accommodating a lighting unit, and, in use, being a clamped adjacent a stair riser by a downward flange on the stair tread moulding".

This illuminating unit does not include means for attaching advertising nor the possibility of adding same.

Among the background art of the invention we may also stress the existence of U.S. Pat. No. 5,340,627, relating to a step-illumination device comprising: "a light fixture housing extrusion having first and second channels formed therein, and a vertical riser plate intersecting with a horizontal step plate at a right angle, the horizontal step plate including a top surface having an integrally-formed lip forming a first carpet insert slot; and a means for removably securing a light fixture in at a means one of the first and second channels".

Patent GB 2 115 451 describes: "a unit for illuminating a step comprising a combination of a stair tread moulding and a second moulding, the second moulding being formed with a recess accommodating a lighting unit, and, in use, being a clamped adjacent a stair riser by a downward flange on the stair tread moulding."

DESCRIPTION OF THE INVENTION

This lit-up marking device for steps, which is of the type that includes a section for positioning same on the front edge of the step or grandstand in question, which section presents two substantially perpendicular wings, a recess in its exterior vertex for fitting lighting means and a protector element, and an upper seat for fitting a strip of non-slip material and a row-numberer has the special feature of including an auxiliary section provided with guides for the fitting of an advertising support which is provided backing onto the riser or vertical surface of the step to be marked, while both sections present complementary means for attachment and detachment of said sections under pressure.

This special feature permits, according to customer needs, fitting of solely the upper section with the lit-up marking means for the step or the grandstand, or the fitting, together with it, of the auxiliary section which includes the guides for fitting the publicity support.

The complementary means for pressure-fitting of the two sections, principal and auxiliary, are defined respectively on the rear side of the former and on the front side of the latter, so that in the fitting position they overlap partially, in such a way that at a glance they appear to form a single section.

The lower end of the front wing of the principal section has a longitudinal channel with guides for fitting of the lighting means for the advertising support and recesses for hooking on a transparent or translucent protector, so that it is not necessary to machine any of the sections in order to fit said lighting means.

In accordance with the invention, the guides for fitting the lighting means are spaced at a short distance from the bottom of the aforesaid channel, leaving defined between them a hollow section for running the power-supply cables.

The seat defined in the principal section for fitting of the non-slip strip and the row-numberer has on its ends some interior mortised inlets, one of which is deeper so as to allow the power-supply cables of the means of lighting of the row-numberer to be run inside it, without any need to machine the section.

In accordance with the invention, the row-numberers have on the side facing the deeper mortised inlet an orifice for housing the corresponding lighting means.

This invention also includes other constructional features which affect: the translucent protector, in order to make the lit-up marking easier on the eye; the means of lighting used to achieve uniform-lighting across the entire width of the section; the side arrangement of LEDs for lighting up the optical fibre, the row-numberers and the advertising supports, together with incorporation of some ducts for the running through of cables for the various steps or the grandstand tiers and for concealed fitting of the LEDs or microbulbs used for side-lighting of the various elements.

As mentioned immediately above, the lighting means can be composed of a section of optical fibre or a slightly shorter length equal to the width of the step, for fitting the longitudinal recess of the section and some LEDs or microbulbs facing at least one of the ends of the section of optical fibre.

Optionally, the LEDs or microbulbs which light up the optical fibre can be housed in one of the ends of the translucent protector or in orifices made in an angle piece, of opaque material, for fitting onto the side ends of the front edge of the step or grandstand, and forming part of ducting for the power-supply cables.

Where the LEDs or the microbulbs are housed in the end of the translucent protector, that protector will have on the corresponding end an opaque section which prevents it being seen by the user.

The angle piece will be used for those cases in which the steps do not have individual power sockets, with such sockets fitted only on the end steps.

In both cases, therefore, the advantage is that the user is not exposed to an intense point of light in the zone in which the LED is located, since the latter is covered either by the angle piece, which is opaque, or by the opaque section of the protector.

The angle piece has side appendages for lateral attachment thereof onto the section placed on the front angle of the step and appendages on its rear and lower ends for attachment to cable-carrying terminal strips inside a longitudinal duct which, together with the angle pieces, form ducting for running the power-supply cables through the successive steps.

Provision has been made for the angle piece to have additional orifices for optional fitting of LEDs or microbulbs that side-light the row-numberers and the advertising supports in those cases in which the steps do not have individual power sockets and recourse has to be had to fitting the ducting mentioned above.

Said angle piece has a lower channel for passing cables from the terminal strips to the side orifices in which the LEDs or microbulbs are fitted.

In order to improve the marking of the steps, and in addition to the use of lengths of optical fibre lit up by the concealed LEDs, provision has been made for the translucent protector fitted on the longitudinal recess to have an upper portion coplanar with the upper surface of the section positioned on the front angle of the step, which makes it easier for users to see, especially when they are descending the stairway.

In accordance with the invention, the translucent protector has to the exterior a convex-curved surface which projects from the longitudinal recess of the section and an upper portion coplanar with the upper surface of the section which lights up a front portion of the horizontal surface of the step, thus making it easier to see for people descending the stairway.

The exterior surface of this translucent protector can have a longitudinal toothing that acts as a light diffuser and prevents users slipping if they tread on it.

Optionally, this protector may have an open, U-shaped arrangement or a tubular arrangement, in this last case being prolonged by the upper zone of the section being extended into a horizontal lug which ends in a U-shaped piece for fixing into one of the upper mortised inlets of the section, and by the front zone of the section into a convex-curved lug whose middle zone projects into a convex-curved lug whose middle zone projects beyond the vertical defined by the front of the section.

DESCRIPTION OF THE DRAWINGS

In order to complement the description being given and in order to facilitate understanding of the characteristics of the invention, this specification is accompanied by a set of drawings which, with illustrative and non-restrictive character, show the following.

PREFERRED EMBODIMENT OF THE INVENTION

Figure 1:
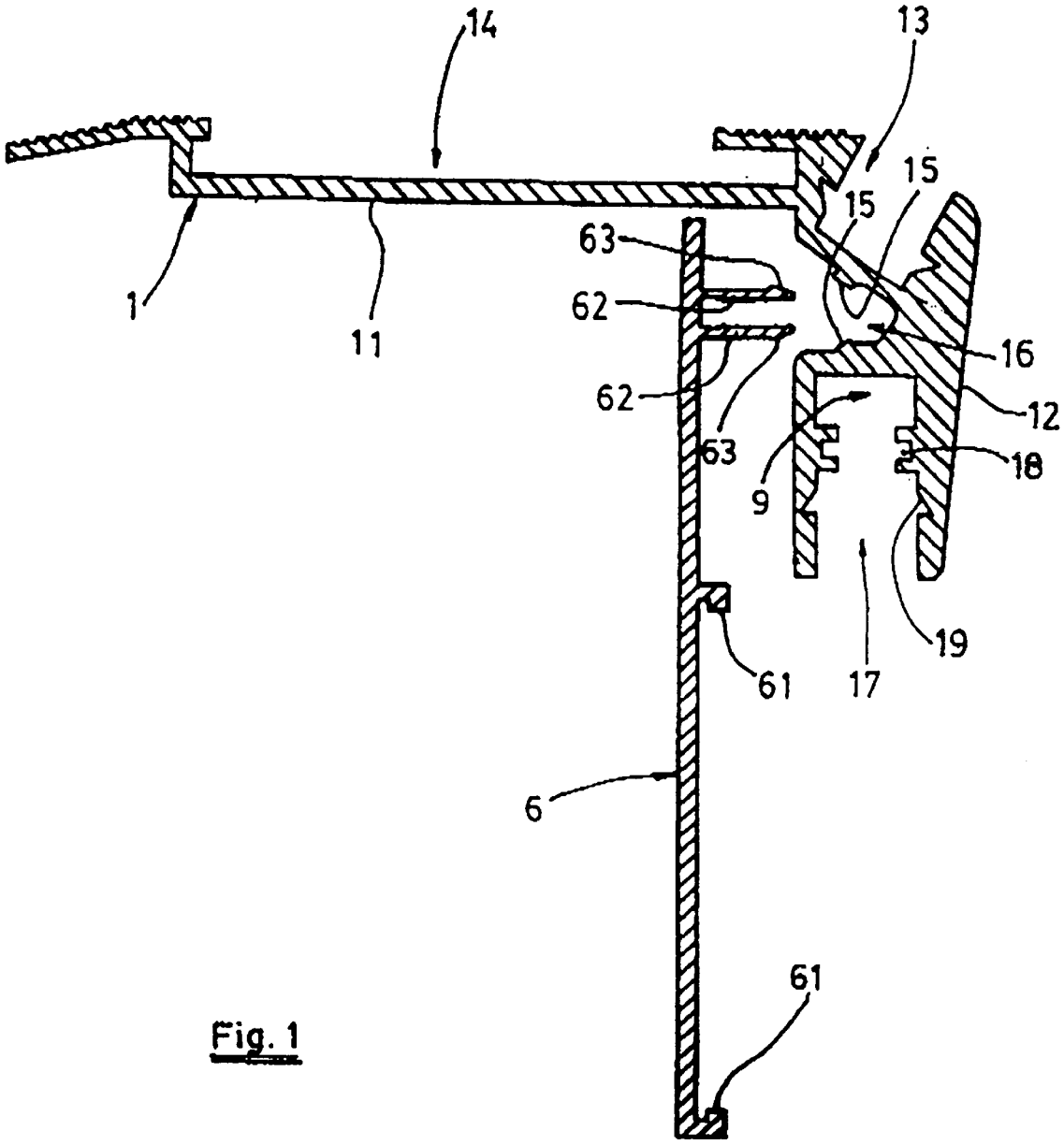
FIG. 1 shows a cross-section of the principal section and the auxiliary section detached from each other.
Figure 2:
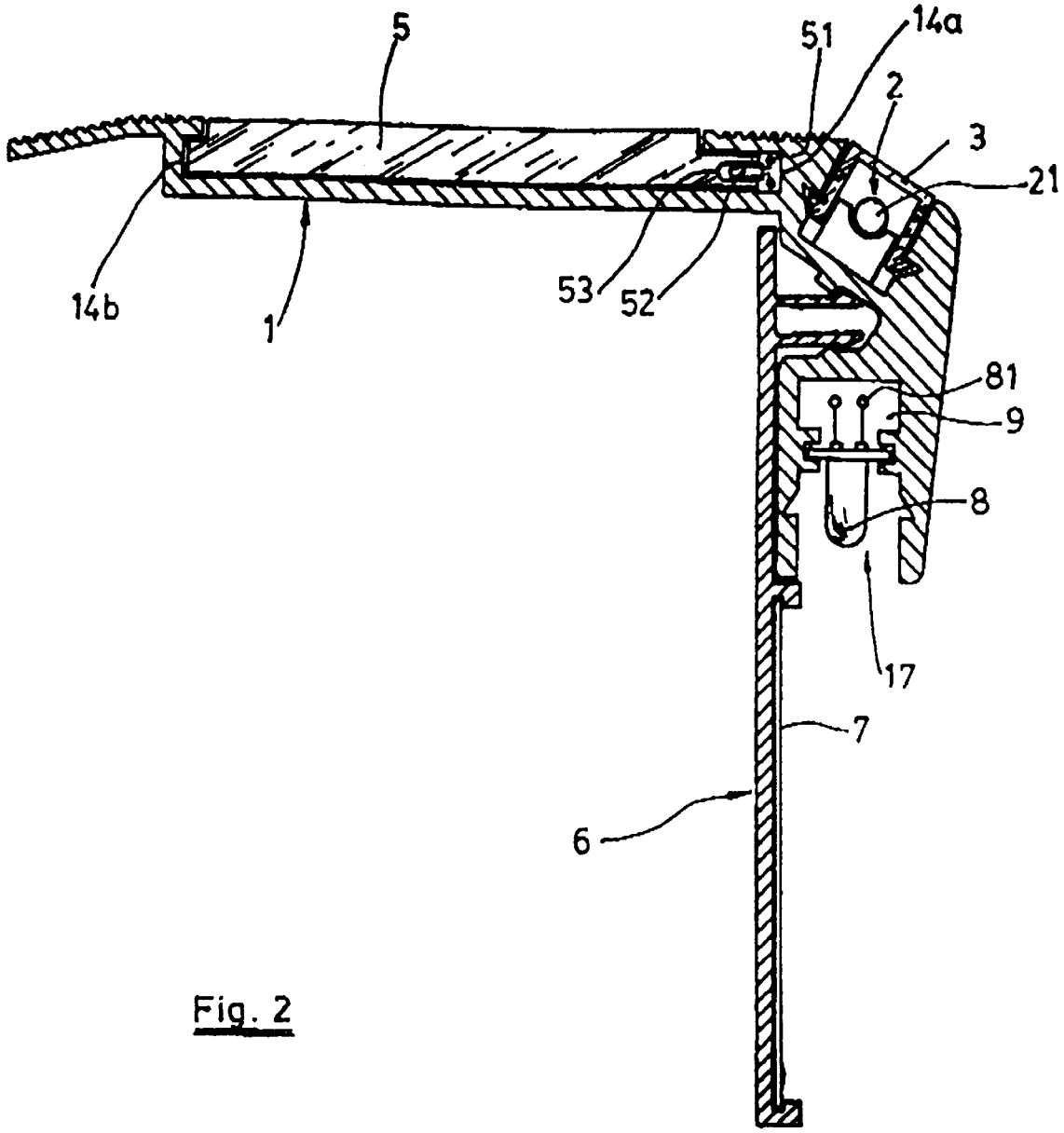
FIG. 2 shows a cross-section of one example of embodiment of the marking device with the various components that form it attached to each other.
Figure 3:
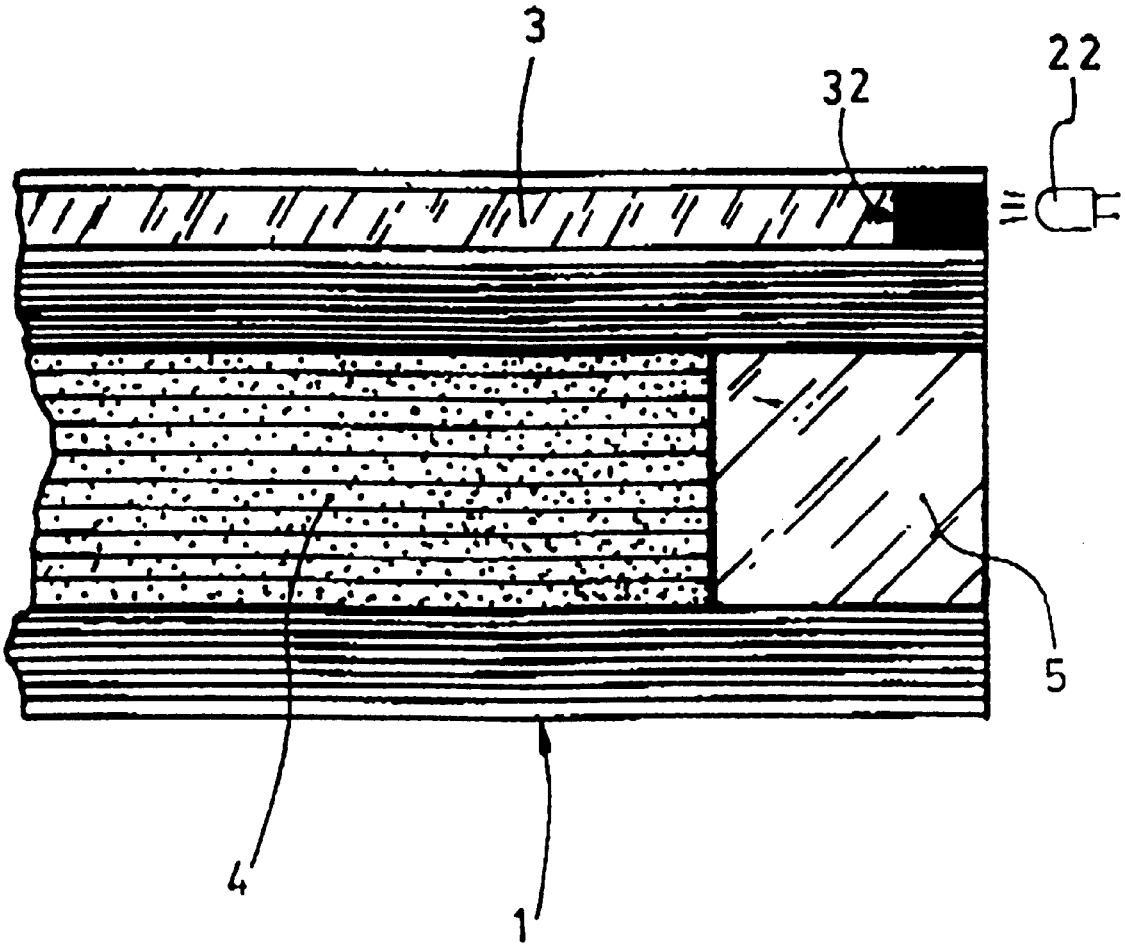
FIG. 3 shows a plan view of the principal section, showing the strip of elastic material and the row-numberer fitted on the upper seat of same and corresponding to the example of embodiment of the previous figure.

As FIGS. 1, 2 and 3 show, this marking device includes a principal section (1) which has two substantially perpendicular wings (II and 12), a recess (13) for the fitting therein of means of lighting (2) and a protecting element (3), an upper seat (14) for fitting therein a strip (4) of non-slip material and a row-numberer (5).

The marking device further includes an auxiliary section (6) provided with guides (61) for the fitting o f an advertising support (7). Both the principal section (1) and the auxiliary section (6) have means of attachment and detachment under pressure, so that the auxiliary section (6) can be included in those assemblies in which it is desirable that the marking device include advertising.

The means of attachment of the principal section (1) are represented by ribs (15) facing each other in a longitudinal cavity (16) defined in the rear side of the wing (12), while those of the auxiliary section (6) are represented by parallel lugs (62) provided with exterior protuberances (63) for hooking there of into the ribs (15) of the principal section (1).

The wing (12) of the principal section (1) has on its lower end a longitudinal channel (17) in which are defined guides (18) for fitting the lighting elements (8) of the advertising support (7), when the steps are provided with the corresponding power sockets, and recesses (19) for attachment of a transparent or translucent protector, similar to that shown with reference number (3).

The guides (18) are spaced at a short distance from the bottom of the channel (17), with a hollow section (9) left between them for the passage of the power-supply cables (81) of the lighting means (8), when the steps are provided with the corresponding power sockets.

The upper seat (14) has on its front and rear ends respective interior mortised sections (14*a* and 14*b*) for guided fitting therein of the row-numberer (5).

The deeper mortised section (14*a*) forms a zone of passage for the power-supply cables (51) of the lighting means (52) of the row-numberers (5) where the steps are provided with the corresponding power-supply sockets, with provision made for said numberers to have on the side facing the aforesaid mortised portion an orifice (53) for housing the corresponding lighting means (52).

Figure 4:
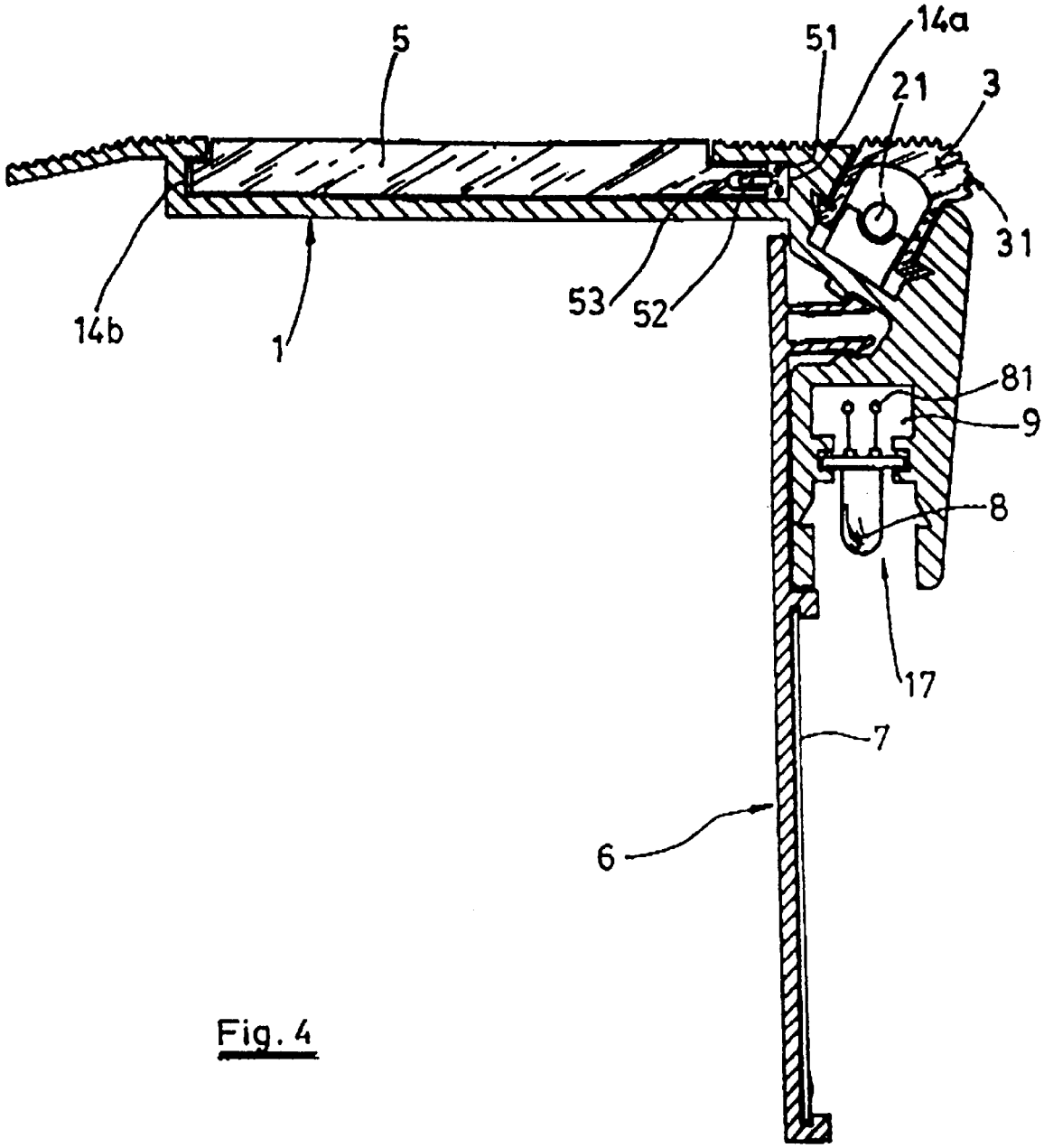
FIG. 4 shows a variant embodiment of translucent protector, with an arrangement projecting with respect to the longitudinal recess of the section and with longitudinal toothing on its exterior surface.
Figure 7:
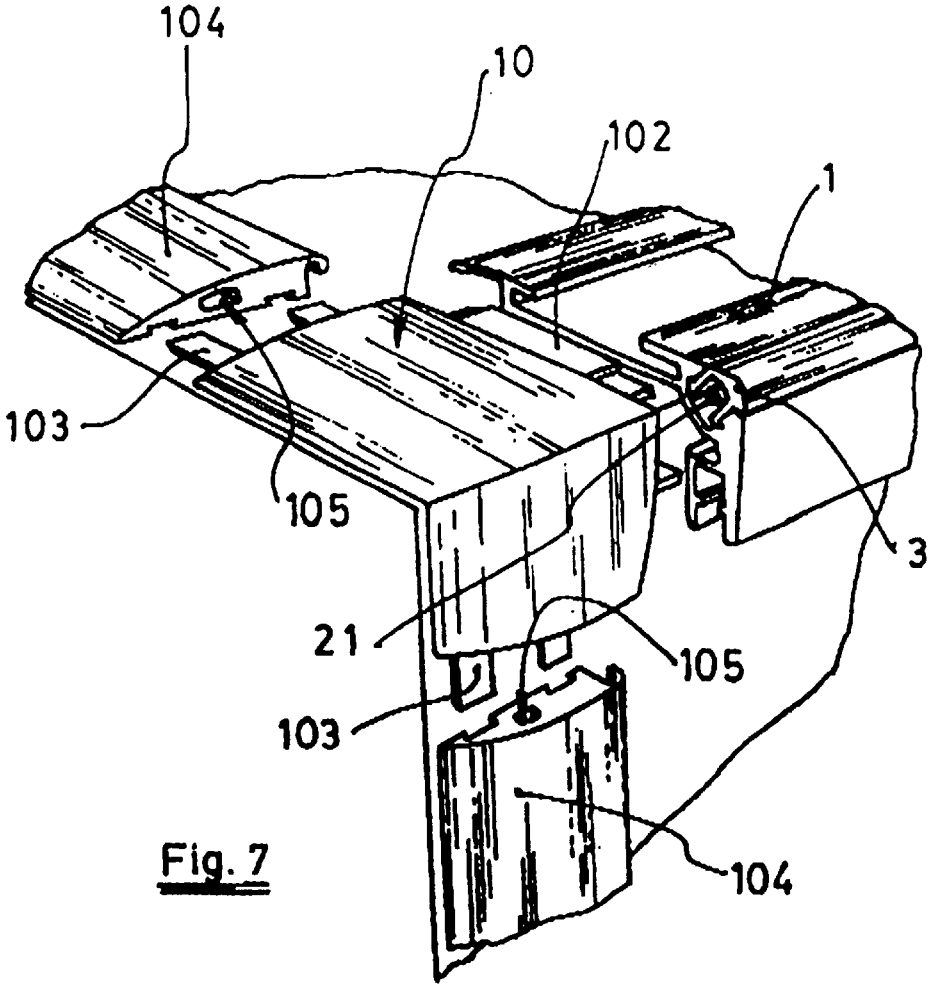
FIG. 7 shows a perspective view of the example of embodiment of the device shown in FIG. 4 and provided with ducting for running through the power-supply cables for the successive steps and for fitting the LEDs which side-light the optical fibre, the row-numberer and the advertising support.
Figure 8:
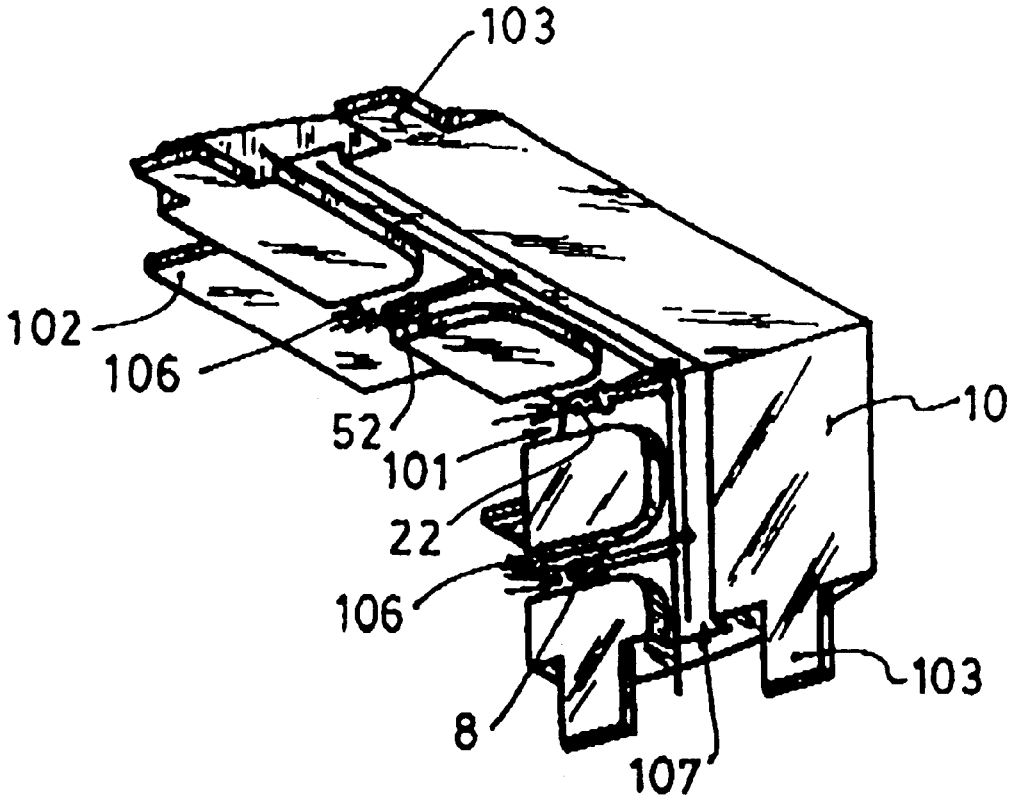
FIG. 8 shows a lower perspective view of the angle piece, showing the arrangement of the LEDs and the channel defined in same for running through the power-supply cables.

Optionally, as shown in FIGS. 4 and 7, the translucent protector (3) having a generally U-shaped arrangement, as in the previous example, can define a convex-curved surface to the exterior, which projects with respect to the recess (13), and longitudinal toothing (31) which acts as a light diffuser.

This translucent protector (3) presents to the exterior an upper portion coplanar with the upper surface of the section (1), thus making it easier to see for people descending the stairway.

Figure 5:
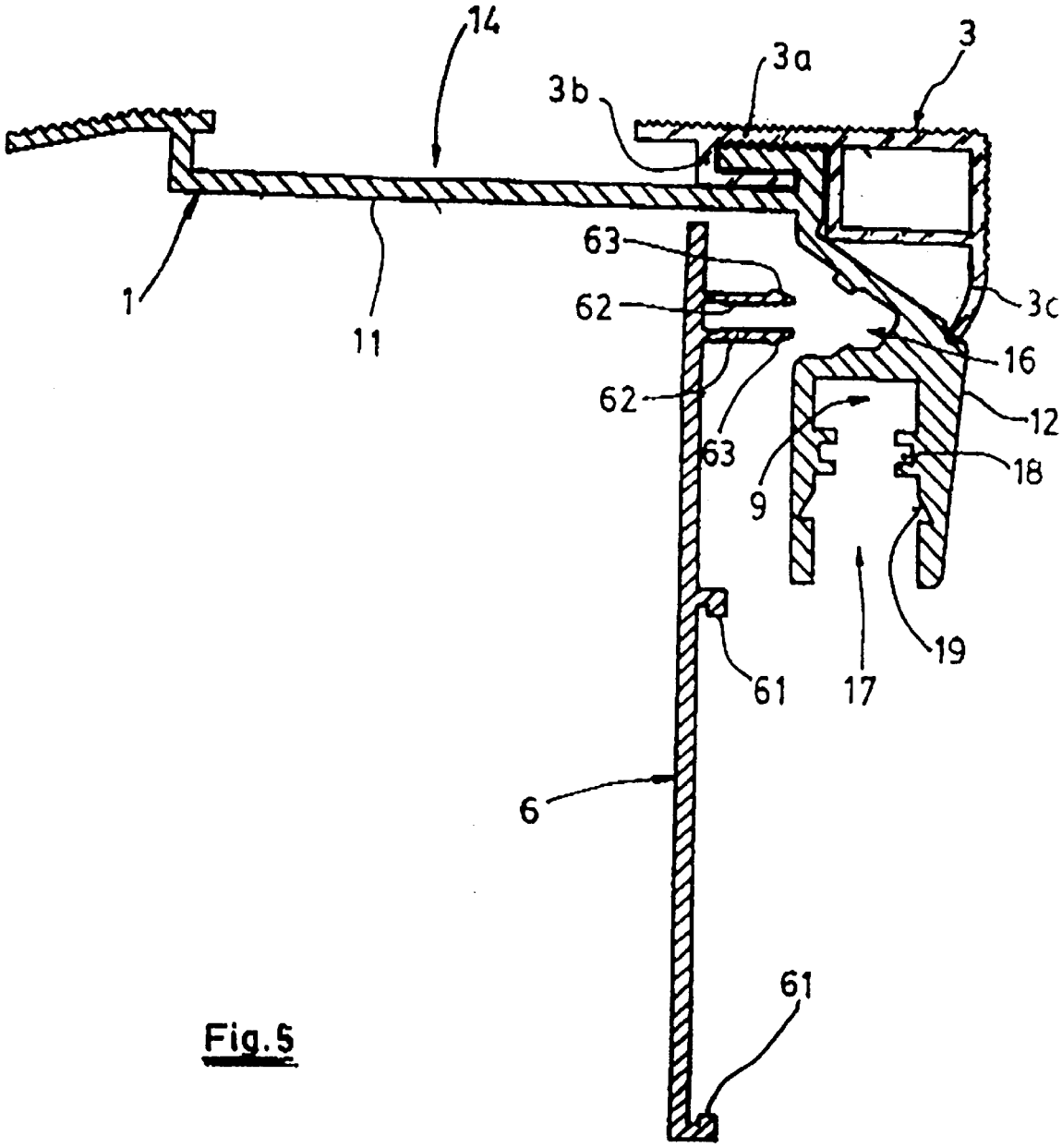
FIG. 5 shows a section view of a variant of embodiment of the device in relation to the longitudinal recess in the section and the arrangement of the translucent protector, which in this case is tubular.
Figure 6:
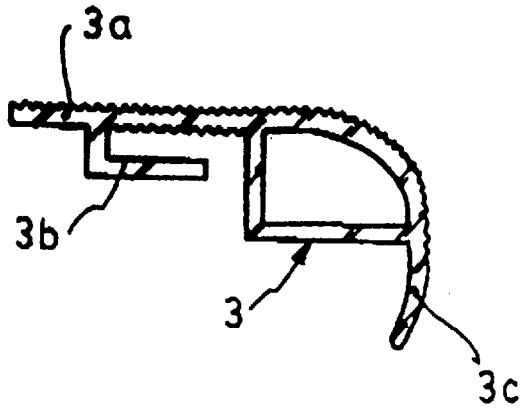
FIG. 6 shows a variant of embodiment of the translucent protector shown in the previous figure.

In the examples of embodiment shown in FIGS. 5 and 6, the translucent protector (3) is of tubular layout, with a rectangular or substantially triangular cross-section respectively, which is prolonged at the upper zone of the section (1) into a horizontal lug (3*a*) that ends in a U-shaped piece (3*b*) for attachment thereof into the mortised portion (14*a*) of the section (1), and at the front zone of said section in a convex-curved lug (3*c*) whose middle zone projects with respect to the vertical defined by the front of the section (1).

The means of lighting (2) comprise a length of optical fibre (21) of slightly shorter length equal to the width of the step, and LEDs or microbulbs (22) facing at least one of the ends of the length of optical fibre.

These microbulbs (22) can be housed in one of the ends of the translucent protector (3), the latter having on the corresponding end an opaque portion (32) which prevents an intense point of light being seen in the zone of the microbulbs, or else, as shown in the figures (7 and 8), in orifices (101) made in an angle piece (10), for fitting on the side ends of the front edge of the step or grandstand and forming part of ducting for the passage of cables. This ducting shown in FIG. 7 will be used in those cases in which the steps are not provided with individual power-supply sockets.

The angle piece (10) has appendages (102) for side coupling thereof to the section (1) and optionally to the section 6, and some appendages (103) for attaching it to the cable-carrying terminal strips (104).

These terminal strips (104) have to the interior a longitudinal channel (105) for running the power-supply cables to the lighting means.

The angle piece (10) has to the side some orifices (106) for the fitting of the LEDs or microbulbs (8 and 52) when side-lighting of the row-numberers (5) and of the advertising supports (7) is desired.

The angle piece (10) is opaque, thus preventing direct viewing of the LEDs or microbulbs (21, 8 and 58) housed in the side orifices (101 and 106).

Said piece (10) has a lower channel (107) for entry of the power-supply cables from the terminal strips (104) to the side orifices (101 and 106).

Having sufficiently described the nature of the invention, together with a preferred embodiment thereof, it is noted for the appropriate purposes that the materials, shape, size and arrangement of the elements described may be modified, as long as this does not involve alteration of the essential characteristics of the invention which are claimed below.

What is claimed is:

1. A lit-up marking device for steps and grandstands, of the type which includes a main section (1) and an auxiliary section (6), the main section having two substantially perpendicular wings (11 and 12), a recess (13) in its exterior vertex for fitting lighting means (2) and a protecting element (3), and an upper seat (14) for fitting a strip (4) of non-slip material and a row numberer (5), and on the auxiliary section (6) some longitudinal guides (61) for the fitting of an advertising support (7), characterised in that it includes:

complementary means for attachment and detachment under pressure of the main section (1) and the auxiliary section (2);

lighting means (8) for the advertising support (7);

angle pieces (10) for positioning on the side ends of the front edge of the step or grandstand, with side appendages (102) for their side attachment onto the main section (1) and end appendages (103) for attaching them to cable-carrying terminal strips (104);

interior mortised portion (14 and 14b) for guided fitting of the row numberer (5) on the front and rear ends of the upper seat of the main section;

row numberers (5) with an orifice (53) in their front side for housing the corresponding lighting means (52); and the translucent protector (3), has an upper section coplanar with the upper surface of the section (1) and a convex-curved surface which projects from the lowered section (13) and has longitudinally a toothed light-diffusing section (31).

2. A device, as claimed in claim 1, characterised in that the means of attachment of the main section (1) are made up of ribs (15) facing each other in a longitudinal cavity (16) formed in the rear side of its wing (12).

3. A device, as claimed in claim 1, characterised in that the means of attachment of the auxiliary section (6) are made up of some parallel projections (62) formed on the front side of the former and provided with some exterior protrusions (63) for hooking them in the ribs (15) of the main section (1).

4. A device, as claimed in claim 1, characterised in that the lighting means (8) of the advertising support (7) are mounted on guides (18) formed in a longitudinal channel (17) of the wing (12), said channel (17) having lowered sections (19) for hooking a transparent or translucent protector into them.

5. A device, claimed in claim 4, characterised in that the guides (18) are spaced at a short distance from the bottom of the channel (17), leaving between them a hollow part (9) sufficiently large to run the power-supply cables (81) of the lighting means (8).

6. A device, claimed in claim 1, characterised in that the recess (14*a*) is deeper than the recess (14*b*), with said recess (14*a*) forming a zone through which can be passed the powers-supply cables (51) of the lighting means (52) of the row numberers (5).

7. A device, as claimed in claim 1, characterised in that the angle pieces (10) have in their sides some orifices (101) for housing LEDs or microbulbs (22) facing one of the ends of a fibre-optic section (21), of a length equal to or slightly less than the width of the step, and that is housed in the lowered section (13) of the main section (1).

8. A device, as claimed in claim 1, characterised in that the angle piece (1) has some orifices (106) for the optional fitting of some LEDs or microbulbs (52, 8) that side-light the row numberers (5) and the advertising supports (7).

9. A device, as claimed in claim 8, characterised in that the angle piece (10) is opaque and prevents the LEDs or microbulbs (22, 8 and 52) housed in the side orifices (101 and 106) from being seen.

10. A device, as claimed in claim 8, characterised in that the angle piece (10) has a lower channel (107) for running the cables from the terminal strips (4) to the side orifices (101 and 108).

11. A device, as claimed in claim 1, characterised in that the translucent protector (3) has a tubular configuration that is prolonged at the upper zone of the section (1) into a horizontal projection (3*a*) that ends in a U-shaped piece (3*b*) for fitting it into the recess (14*a*), and at the front zones of the section (1) into a convex-curved projection (3*c*) whose middle zone projects in relation to the vertical formed by the front of the section (1).

* * * * *